US012674325B1

(12) United States Patent
Thayil et al.

(10) Patent No.: US 12,674,325 B1
(45) Date of Patent: Jul. 7, 2026

(54) ADJUSTABLE ROOF VENT ASSEMBLY AND A METHOD OF MAKING THEREOF

(71) Applicant: BMIC LLC, Dallas, TX (US)

(72) Inventors: Bijoy John Thayil, Raleigh, NC (US); Tyler Wendel Haag, Chinquapin, NC (US); Kevin Ray Brown, Jacksonville, NC (US); Steven Vonderlehr Boehling, Wilmington, NC (US)

(73) Assignee: BMIC LLC, Dallas, TX (US)

( * ) Notice: Subject to any disclaimer, the term of this patent is extended or adjusted under 35 U.S.C. 154(b) by 253 days.

(21) Appl. No.: 18/487,570

(22) Filed: Oct. 16, 2023

Related U.S. Application Data

(60) Provisional application No. 63/417,004, filed on Oct. 18, 2022, provisional application No. 63/521,888, filed on Jun. 20, 2023.

(51) Int. Cl.
*E04D 13/147* (2006.01)
*F24F 7/00* (2021.01)
*F24F 7/02* (2006.01)

(52) U.S. Cl.
CPC ..... *E04D 13/147* (2013.01); *F24F 7/02* (2013.01); *F24F 2007/001* (2013.01)

(58) Field of Classification Search
CPC ..... E04D 13/147; F24F 7/02; F24F 2007/001
See application file for complete search history.

(56) References Cited

U.S. PATENT DOCUMENTS 530,574 A 12/1894 Bignall
807,795 A 12/1905 Watson
885,318 A 4/1908 Bullard
917,385 A 4/1909 Wallace
921,752 A 5/1909 Ulrich
1,192,279 A 7/1916 Dawson
1,202,687 A * 10/1916 Elkerton ..... E04D 13/1471 285/43
1,279,572 A 9/1918 Moore
1,317,574 A 9/1919 Grosvold
1,332,224 A * 3/1920 McHale ..... E04D 13/1471 285/44
1,704,942 A 3/1929 Hopson
(Continued)

FOREIGN PATENT DOCUMENTS

CA 2184846 A1 3/1998
CN 201478448 U * 5/2010
(Continued)

*Primary Examiner* — Omar F Hijaz
(74) *Attorney, Agent, or Firm* — Venable LLP

(57) ABSTRACT

This invention, in embodiments, relates to an adjustable roof vent assembly comprising (a) a base configured to attach to a roof, wherein the base is configured to allow a vent pipe that extends from the roof to extend through the base, and (b) a ball joint mechanism that includes (i) an inner ball member attached to the base and (ii) an outer ball member having a roof cap. The outer ball member is configured to freely rotate around the inner ball member, and the roof cap is configured to extend around the vent pipe. The ball joint mechanism is configured to allow for free rotation of the adjustable roof vent assembly in two planes while reducing lateral movement in any direction. This invention, in embodiments, further relates to a method of manufacturing such a roof vent assembly.

18 Claims, 15 Drawing Sheets

(56) References Cited

U.S. PATENT DOCUMENTS

| | | | | |
|---|---|---|---|---|
| 2,113,872 | A * | 4/1938 | Brown | F24F 7/02 454/36 |
| 3,337,247 | A | 8/1967 | Moskovitz | |
| 3,436,880 | A | 4/1969 | Kifer | |
| 3,587,154 | A | 6/1971 | Potter | |
| 3,731,952 | A | 5/1973 | Elwart | |
| 3,850,443 | A | 11/1974 | Hassan | |
| 4,115,961 | A | 9/1978 | Bishop | |
| 4,372,585 | A | 2/1983 | Evora | |
| 4,768,812 | A | 9/1988 | Katz | |
| 4,843,794 | A | 7/1989 | Holtgreve | |
| 5,193,390 | A * | 3/1993 | Nill, Jr. | G01M 3/16 73/335.02 |
| 5,349,362 | A * | 9/1994 | Forbes | H01Q 1/42 343/873 |
| 5,390,451 | A | 2/1995 | Kopp et al. | |
| 5,694,724 | A * | 12/1997 | Santiago | E04D 13/1476 285/44 |
| 5,778,611 | A | 7/1998 | Michel | |
| 6,093,098 | A * | 7/2000 | Wilhelmson | H01Q 1/42 454/367 |
| 6,163,960 | A | 12/2000 | Poitras | |
| 6,279,272 | B1 | 8/2001 | Nill, Jr. | |
| 7,770,937 | B2 | 8/2010 | Ignaczak et al. | |
| 8,272,186 | B2 | 9/2012 | Manning | |
| 8,291,658 | B1 | 10/2012 | Johnston et al. | |
| 8,397,438 | B2 | 3/2013 | Hoy et al. | |
| 8,484,914 | B2 | 7/2013 | Cline | |
| 8,490,351 | B1 | 7/2013 | Scott | |
| D697,919 | S | 1/2014 | Gelsomini et al. | |
| 8,757,648 | B1 | 6/2014 | Winter | |
| 8,794,098 | B2 | 8/2014 | Long | |
| 8,845,406 | B2 * | 9/2014 | McIver | F24F 7/02 454/367 |
| 8,951,294 | B2 | 2/2015 | Gennari et al. | |
| 8,984,822 | B1 | 3/2015 | Cline et al. | |
| 9,169,648 | B1 | 10/2015 | Mills | |
| 9,228,689 | B1 | 1/2016 | Cline et al. | |
| 9,291,195 | B1 | 3/2016 | Parker et al. | |
| 9,316,250 | B2 | 4/2016 | Elterman et al. | |
| 9,360,141 | B2 | 6/2016 | Menheere | |
| 9,377,156 | B2 | 6/2016 | Wong | |
| 9,394,936 | B2 | 7/2016 | Long | |
| 9,534,392 | B2 | 1/2017 | Wey | |
| 9,724,836 | B2 | 8/2017 | Bond | |
| 9,981,512 | B2 | 5/2018 | Gentner | |
| 10,309,449 | B2 | 6/2019 | Schmidt et al. | |
| D856,441 | S | 8/2019 | Baker | |
| 10,571,141 | B1 * | 2/2020 | Gray | E04D 13/006 |
| D884,093 | S | 5/2020 | Baker | |
| 2003/0024185 | A1 | 2/2003 | Menzies | |
| 2006/0211356 | A1 | 9/2006 | Grassman | |
| 2008/0271391 | A1 | 11/2008 | Dalmasso | |
| 2010/0109318 | A1 | 5/2010 | Mulligan | |
| 2012/0190288 | A1 * | 7/2012 | Willen | E04D 13/1476 454/250 |
| 2013/0020796 | A1 | 1/2013 | Humber | |
| 2013/0205693 | A1 | 8/2013 | Scott | |

FOREIGN PATENT DOCUMENTS

| | | | |
|---|---|---|---|
| DE | 2519442 | A1 | 11/1976 |
| DE | 4328683 | A1 | 3/1995 |
| DE | 29514513 | U1 | 11/1995 |
| DE | 29602618 | U1 | 3/1996 |
| DE | 19921069 | C1 | 10/2000 |
| DE | 10139224 | A1 | 10/2002 |
| DE | 10139225 | A1 | 2/2003 |
| EP | 0568766 | A1 | 11/1993 |
| EP | 0658235 | A1 | 6/1995 |
| EP | 0715671 | B1 | 12/1998 |
| EP | 0992638 | A1 | 4/2000 |
| EP | 1215448 | A2 | 6/2002 |
| EP | 2492411 | A2 | 8/2012 |
| EP | 3101194 | A1 | 12/2016 |
| GB | 1218490 | A | 1/1971 |
| WO | 1997041979 | A1 | 11/1997 |
| WO | 2008045124 | A1 | 4/2008 |

* cited by examiner

ADJUSTABLE ROOF VENT ASSEMBLY AND A METHOD OF MAKING THEREOF

This application claims the priority of U.S. provisional application Ser. No. 63/417,004 entitled "Adjustable Roof Vent Assembly and a Method of Making Thereof" filed Oct. 18, 2022, and U.S. provisional application Ser. No. 63/521,888 entitled "Adjustable Roof Vent Assembly and a Method of Making Thereof" filed Jun. 20, 2023, which are incorporated herein by reference in their entireties for all purposes.

FIELD OF THE INVENTION

This invention relates to adjustable roof vent assemblies and methods of making these roof vent assemblies. The adjustable roof vent assemblies of the present disclosure are configured to be positioned on a vent or plumbing pipe that extends upwardly from a roof.

BACKGROUND OF THE INVENTION

Roof vents have to adjust to the pitch of an installed roof such that any vent or plumbing pipe can exit vertically through the roof. Currently available roof vents use a variety of soft materials, such as, e.g., rubber, lead, plastic, etc., to achieve this adjustability.

SUMMARY OF THE INVENTION

One embodiment of this invention pertains to an adjustable roof vent assembly comprising (a) a base configured to attach to a roof, wherein the base is configured to allow a vent pipe that extends from the roof to extend through the base, and (b) a ball joint mechanism that includes (i) an inner ball member attached to the base and (ii) an outer ball member having a roof cap, wherein the outer ball member is configured to freely rotate around the inner ball member, and wherein the roof cap is configured to extend around the vent pipe. The ball joint mechanism is configured to allow for free rotation of the adjustable roof vent assembly in two planes while reducing lateral movement in any direction.

In one embodiment, the adjustable roof vent assembly further comprises an outer sleeve member that is configured to be positioned on the roof cap of the outer ball member. In another embodiment, the outer sleeve member includes an inner sleeve that is configured to be positioned within the vent pipe that extends from the roof.

In one embodiment, the outer sleeve member further includes a top cover and a bezel member, wherein the bezel member is attached to an inner portion of the top cover. In another embodiment, the inner sleeve comprises one or more tab members that are configured to engage with the bezel member. In an embodiment, the bezel member includes one or more slots that are configured to engage with the one or more tab members of the inner sleeve to attach the inner sleeve to the bezel member. In another embodiment, the bezel member further includes one or more detents that are configured to (i) hold the inner sleeve in place and (ii) prevent over-rotation of the inner sleeve when attaching the inner sleeve to the bezel member.

In one embodiment, the inner sleeve includes one or more protrusions that are configured to grip an inside wall of the vent pipe that extends from the roof.

In one embodiment, the inner sleeve includes one or more slits that are configured to adapt to a diameter of the vent pipe that extends from the roof.

In one embodiment, the inner sleeve comprises a plastic material.

In one embodiment, the bezel member is welded to the inner portion of the top cover of the outer sleeve member.

In one embodiment, the base comprises roof flashing.

In one embodiment, the inner ball member of the ball joint mechanism is mechanically attached to the base.

In one embodiment, the ball joint mechanism is configured to allow for free rotation of the adjustable roof vent assembly in two planes while preventing lateral movement in any direction.

Another embodiment of this invention pertains to an adjustable roof vent assembly that allows for roof top connectivity. The adjustable roof vent assembly comprises (a) a base configured to attach to a roof, wherein the base is configured to allow a vent pipe that extends from the roof to extend through the base, (b) a ball joint mechanism that includes (i) an inner ball member attached to the base and (ii) an outer ball member having a roof cap, wherein the outer ball member is configured to freely rotate around the inner ball member, and wherein the roof cap is configured to extend around the vent pipe, and (c) an antenna disposed within the adjustable roof vent assembly to allow for the adjustable roof vent assembly to be used as an antenna for roof top connectivity.

In one embodiment, the base includes antenna electronics.

In one embodiment, the adjustable roof vent assembly further comprises an outer sleeve member that is configured to be positioned on the roof cap of the outer ball member. In another embodiment, the outer sleeve member includes an inner sleeve that is configured to be positioned within the vent pipe that extends from the roof.

In one embodiment, the outer sleeve member includes at least one antenna. In another embodiment, the at least one antenna comprises a non-metal for signal transmission.

In one embodiment, the outer sleeve member comprises a top cover that provides a mounting point for one or more antennas.

In one embodiment, the outer sleeve member further includes a top cover and a bezel member, wherein the bezel member is attached to an inner portion of the top cover. In another embodiment, the inner sleeve comprises one or more tab members that are configured to engage with the bezel member. In an embodiment, the bezel member includes one or more slots that are configured to engage with the one or more tab members of the inner sleeve to attach the inner sleeve to the bezel member. In another embodiment, the bezel member further includes one or more detents that are configured to (i) hold the inner sleeve in place and (ii) prevent over-rotation of the inner sleeve when attaching the inner sleeve to the bezel member.

In one embodiment, the inner sleeve includes one or more protrusions that are configured to grip an inside wall of the vent pipe that extends from the roof.

In one embodiment, the inner sleeve includes one or more slits that are configured to adapt to a diameter of the vent pipe that extends from the roof.

In one embodiment, the inner sleeve comprises a plastic material.

In one embodiment, the bezel member is welded to the inner portion of the top cover of the outer sleeve member.

In one embodiment, the base comprises roof flashing.

In one embodiment, the inner ball member of the ball joint mechanism is mechanically attached to the base.

In one embodiment, the ball joint mechanism is configured to allow for free rotation of the adjustable roof vent assembly in two planes while reducing lateral movement in any direction.

In one embodiment, the ball joint mechanism is configured to allow for free rotation of the adjustable roof vent assembly in two planes while preventing lateral movement in any direction.

Another embodiment of this invention pertains to a method of manufacturing a roof vent assembly. The method comprises (a) obtaining an outer ball member, (b) obtaining a cylindrical inner tube member, (c) inserting the cylindrical inner tube member into the outer ball member, such that the outer ball member is positioned around the cylindrical inner tube member, and expanding the cylindrical inner tube member within the outer ball member to form an inner ball member of a ball joint mechanism of a roof vent assembly.

In one embodiment, the step of obtaining an outer ball member is conducted by forming the outer ball member from a cylindrical tube using an expander tool.

In one embodiment, the step of expanding the cylindrical inner tube member is conducted using a material expansion process. In another embodiment, the material expansion process comprises a metal expansion process.

In one embodiment, the step of expanding the cylindrical inner tube member is conducted using an expander tool. In another embodiment, the expander tool is configured to adjust from an unexpanded state to an expanded state to expand the cylindrical inner tube member within the outer ball member to form the inner ball member of a ball joint mechanism of a roof vent assembly.

In one embodiment, the step of expanding the cylindrical inner tube member is conducted until the cylindrical inner tube member is expanded to form an inner ball member that is sized smaller than the outer ball member.

In one embodiment, the ball joint mechanism comprises a ball and socket joint.

BRIEF DESCRIPTION OF THE FIGURES

For a more complete understanding of the invention and the advantages thereof, reference is made to the following descriptions, taken in conjunction with the accompanying figures, in which.

DETAILED DESCRIPTION OF THE INVENTION

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising," "including," and "having" do not limit the scope of a specific claim to the materials or steps recited by the claim.

As used herein, terms such as "consisting of" and "composed of" limit the scope of a specific claim to the materials and steps recited by the claim.

This invention relates to ball joints or ball joint mechanisms, including, e.g., ball joints of the type used in roof applications (e.g., roof vents or pipe boots) to vent pipes through the roof. According to an embodiment, the roof vent or roof vent assembly of the present invention provides users with a durable roof vent that can easily adjust to varying roof slopes.

As discussed, roof vents have to adjust to the pitch of an installed roof so that any vent or plumbing pipe can exit vertically through the roof. Currently available roof vents use a variety of soft materials, such as, e.g., rubber, lead, plastic, etc., to achieve this adjustability. However, the adjustable roof vent assembly of the present invention provides an easy to adjust roof vent that allows for free rotation of the roof vent in two planes, while preventing translation (lateral movement) in any direction.

Figure 1A:
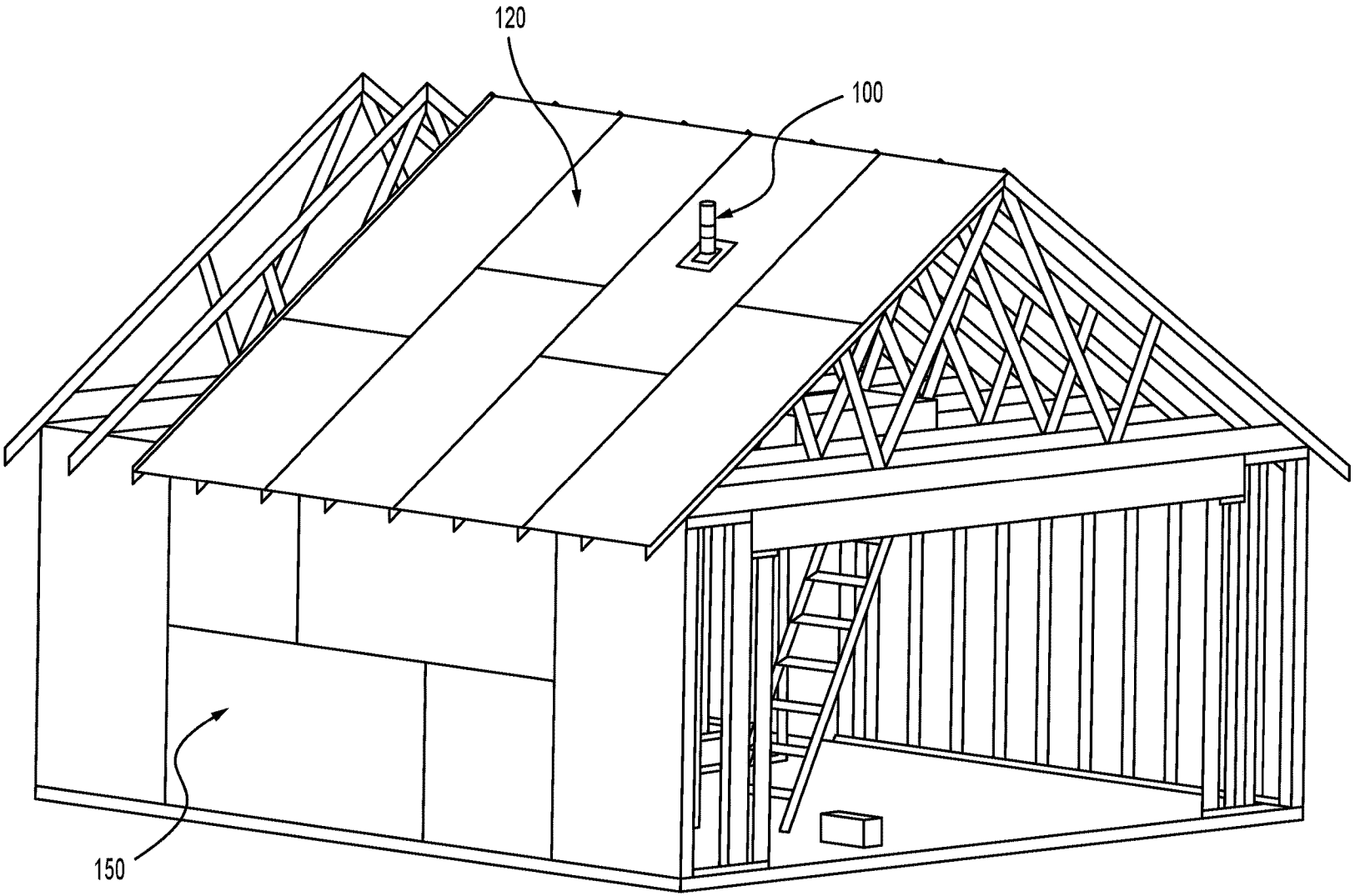
FIGS. 1A and 1B are an illustration of an adjustable roof vent assembly positioned on a roof according to an embodiment of the invention.
Figure 1B:
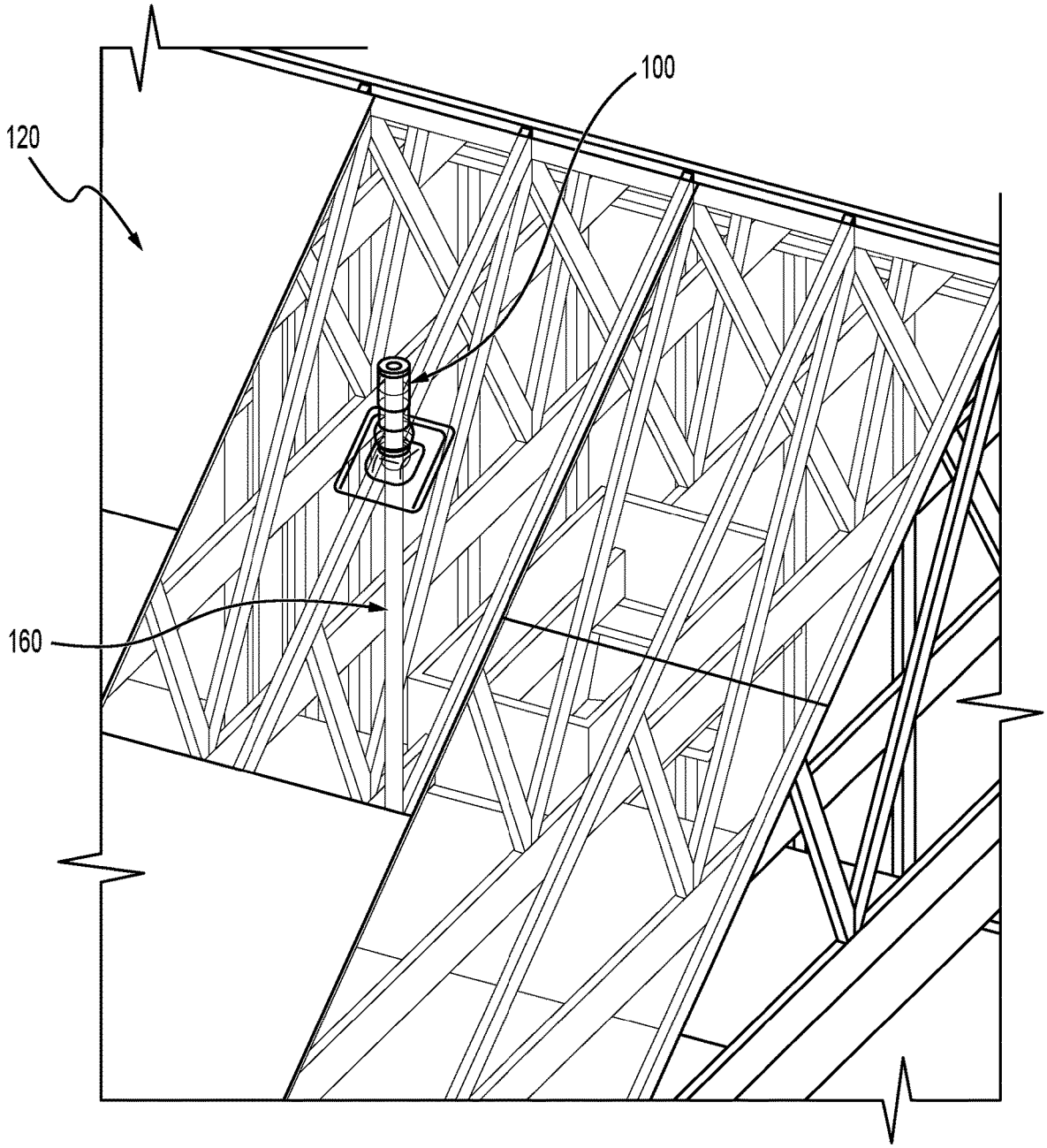

One embodiment of this invention pertains to an adjustable roof vent assembly. FIGS. 1A and 1B illustrate an adjustable roof vent assembly 100 according to an embodiment of the invention. As shown in FIGS. 1A and 1B, the adjustable vent roof assembly 100 is positioned on a roof 120 of a building 150. In particular, as shown in FIG. 1B, the adjustable roof vent assembly 100 (also called a "pivot boot") is positioned on a vent pipe 160 (e.g., a PVC vent pipe from the building 150) that extends through the roof 120. As further shown in FIGS. 1A and 1B, although the roof 120 has a certain pitch or slope, the adjustable roof vent assembly 100 is able to adjust and/or be positioned on the vent pipe 160 and the roof 120 such that the vent pipe 160 is able to extend vertically through the roof 120.

According to an embodiment, the adjustable roof vent assembly comprises (a) a base configured to attach to a roof, wherein the base is configured to allow a vent pipe that extends from the roof to extend through the base, and (b) a ball joint mechanism that includes (i) an inner ball member attached to the base and (ii) an outer ball member having a roof cap, wherein the outer ball member is configured to freely rotate around the inner ball member, and wherein the roof cap is configured to extend around the vent pipe. The ball joint mechanism is configured to allow for free rotation of the adjustable roof vent assembly in two planes while reducing lateral movement (translation) in any direction.

In one embodiment, the ball joint mechanism is configured to allow for free rotation of the adjustable roof vent assembly in two planes while preventing lateral movement in any direction.

Figure 2:
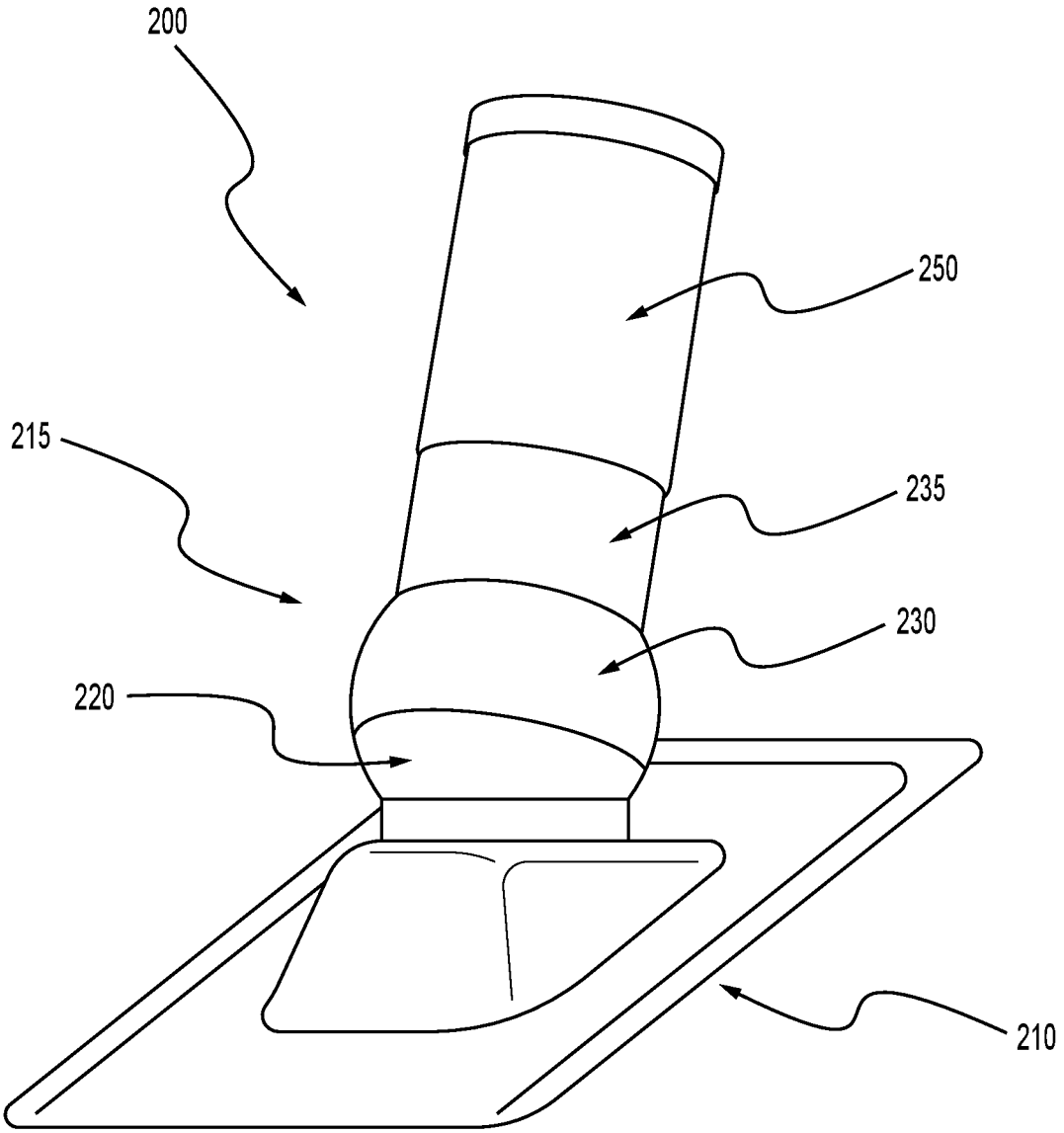
FIG. 2 is an illustration of an adjustable roof vent assembly according to an embodiment of the invention.

FIG. 2 illustrates an adjustable roof vent assembly 200 according to an embodiment of the invention. In this embodiment, the adjustable roof vent assembly 200 includes a base 210 (e.g., roof flashing) that is configured to attach to a roof (see, e.g., roof 120 of building 150 of FIG. 1A). The base 210 is further configured to allow a vent pipe that extends through the roof to extend through the base 210 (see, e.g., vent pipe 160 that extends through roof 120 of building 150 of FIG. 1B). The adjustable roof vent assembly 200 further includes a ball joint mechanism 215 that includes (i) an inner ball member 220 attached to the base 210 and (ii) an outer ball member 230 having a roof cap 235. In one embodiment, the inner ball member 220 of the ball joint mechanism 215 is mechanically attached to the base 210. The outer ball member 230 is able to freely rotate around the inner ball member 220 (see, e.g., FIGS. 3A and 3B). The roof cap 235 of the outer ball member 230 is configured to extend around a vent pipe that extends through the roof (see, e.g., vent pipe 160 that extends through roof 120 of building 150 of FIG. 1B). As further shown in FIG. 2, the adjustable roof vent assembly 200 can also include an outer sleeve member 250 (described in further detail below) that can attach and/or engage with the roof cap 235 of the outer ball member 230.

Figure 3B:
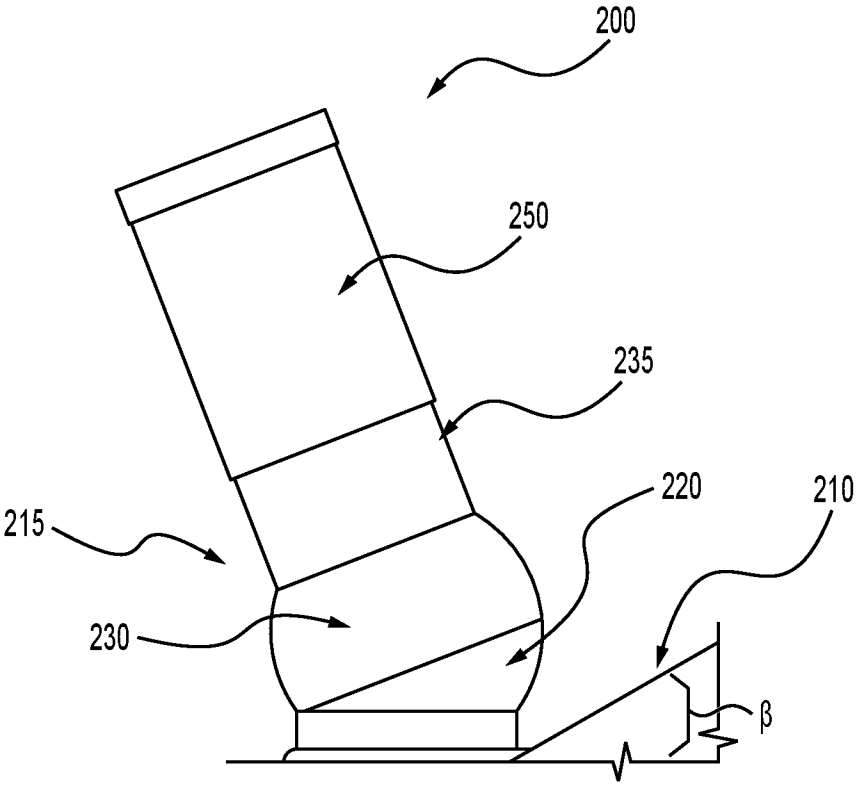
FIGS. 3A and 3B are an illustration of an adjustable roof vent assembly in two different positions according to an embodiment of the invention.
Figure 3A:
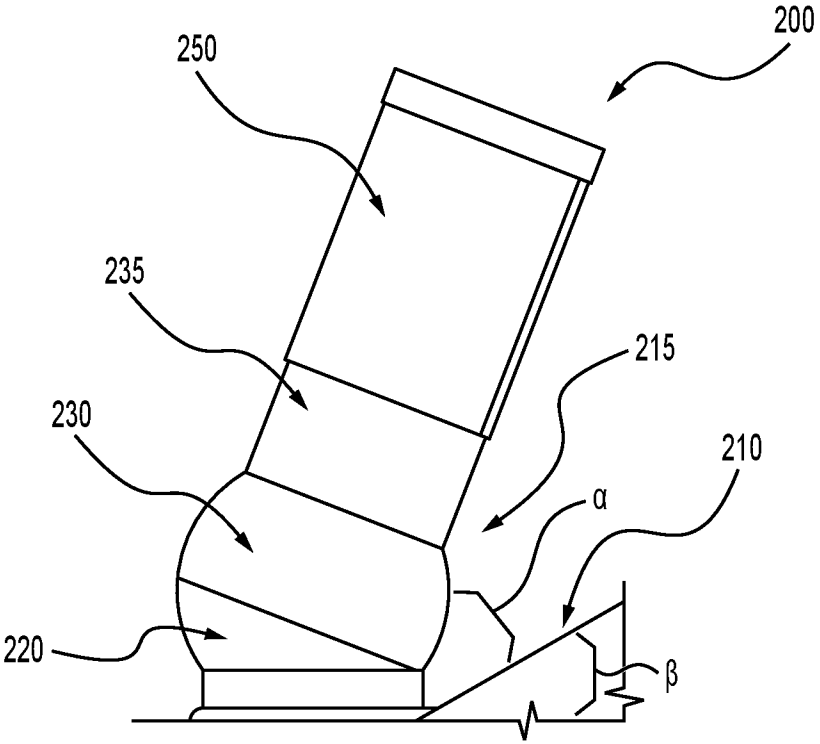

FIGS. 3A and 3B illustrate the adjustable roof vent assembly 200 of FIG. 2 in two different adjustable positions. As shown in FIG. 3A, the outer ball member 230 of the ball joint mechanism 215 has been rotated around the inner ball member 220, such that the outer ball member 230, the roof cap 235 and the outer sleeve member 250 extend an at angle ($\alpha$) toward the angle ($\beta$) at which the base 210 extends. By contrast, as shown in FIG. 3B, the outer ball member 230 of the ball joint mechanism 215 has been rotated around the inner ball member 220 in an alternative direction to that of FIG. 3A, such that the outer ball member 230, the roof cap 235 and the outer sleeve member 250 extend at an angle that is opposite to the angle ($\beta$) at which the base 210 extends. Accordingly, the embodiments of FIGS. 3A and 3B illustrate the adjustability of the adjustable roof vent assembly 200 (e.g., "pivot boot") on the ball joint or ball joint mechanism 215.

Figure 4A:
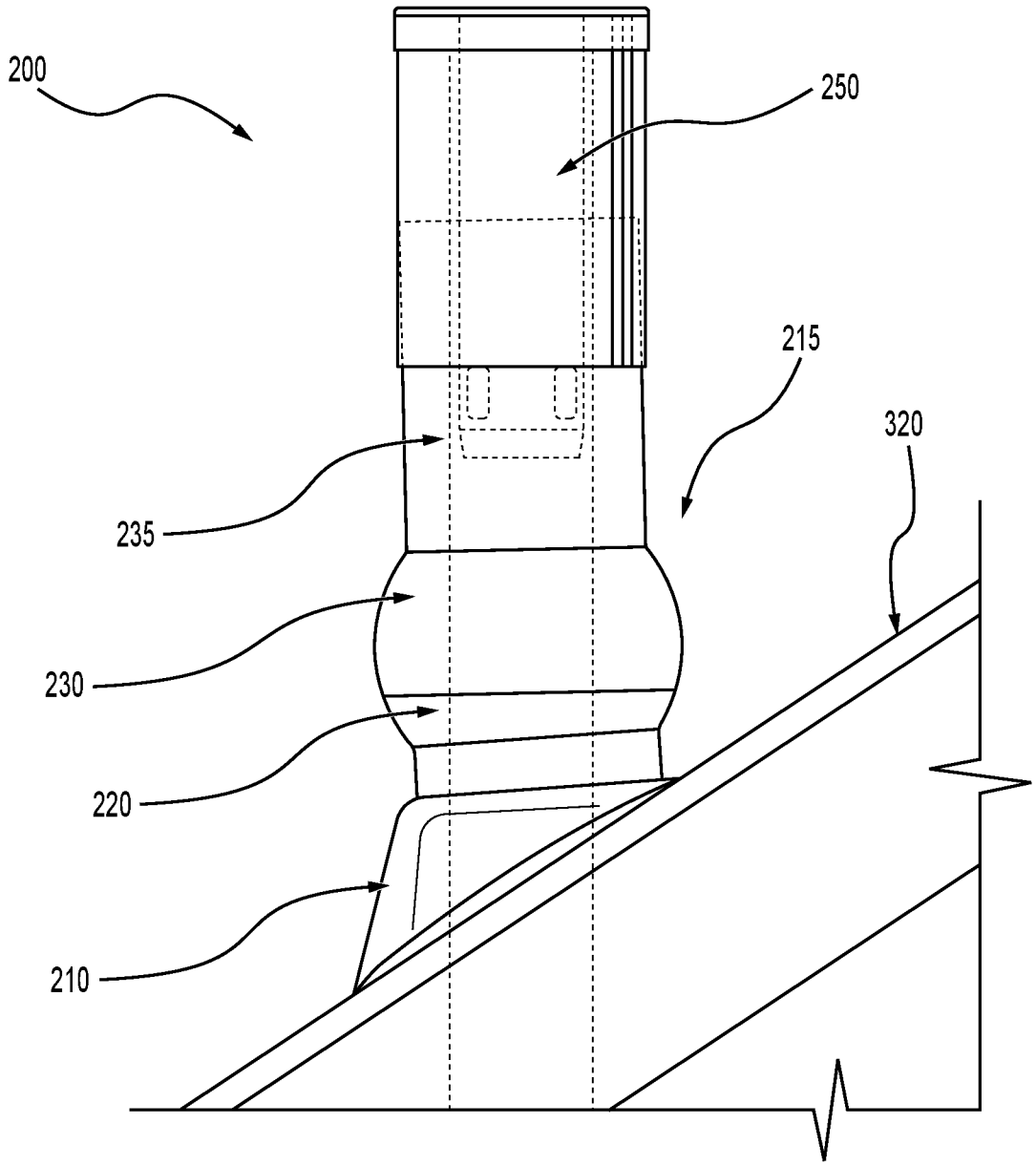
FIG. 4A is an illustration of an adjustable roof vent assembly according to an embodiment of the invention.
Figure 4B:
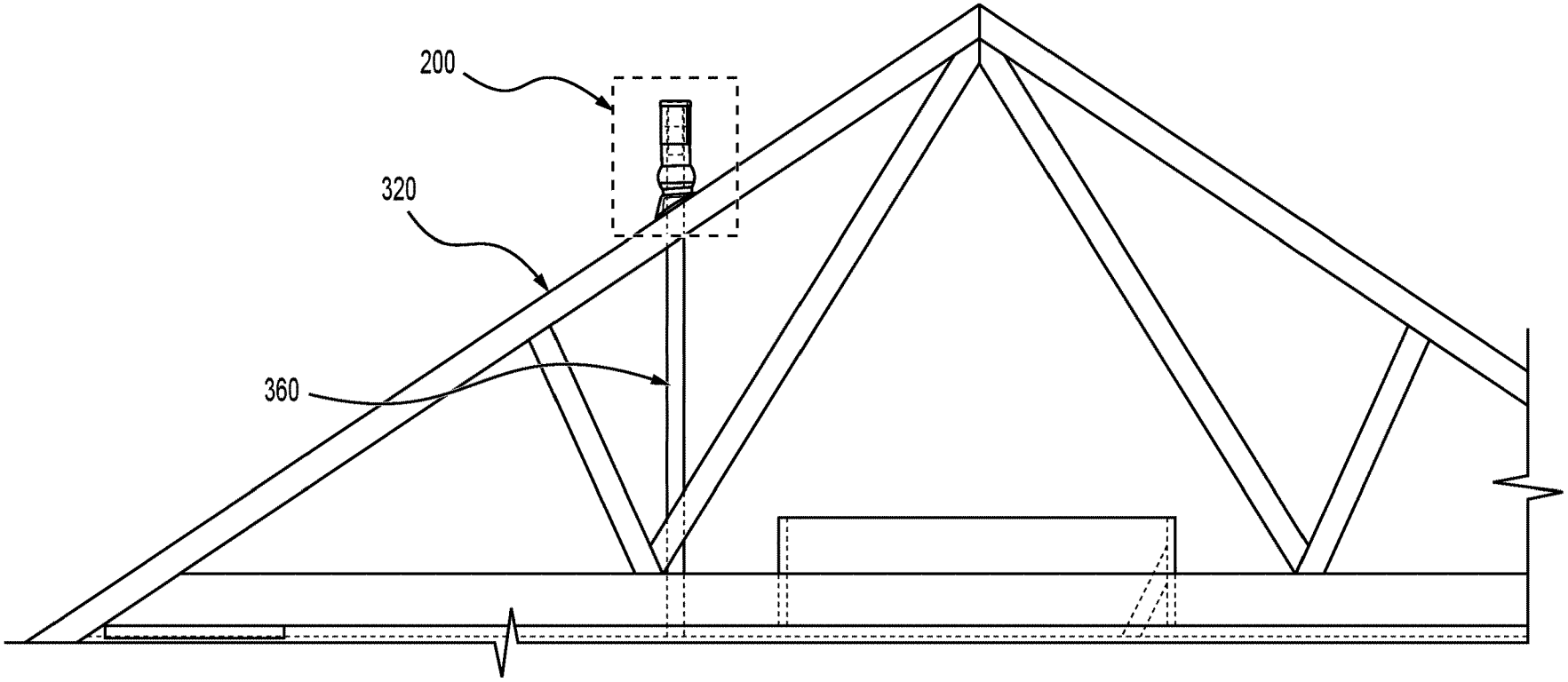
FIG. 4B is an illustration of the adjustable roof vent assembly shown in FIG. 4A positioned on a roof according to an embodiment of the invention.

FIGS. 4A and 4B illustrate the adjustable roof vent assembly 200 shown in FIG. 2 being positioned on a roof according to an embodiment of the invention. As shown in FIGS. 4A and 4B, the adjustable roof vent assembly 200 is positioned on a vent pipe 360 that extends through a roof 320, with the base 210 of the adjustable roof vent assembly 200 being attached to the roof 320. As further shown in FIGS. 4A and 4B, the base 210 of the adjustable roof vent assembly 200 extends along an angle that matches the pitch or slope of the roof 320. However, the outer ball member 230 of the ball joint mechanism 215 is rotated around the inner ball member 220, such that the roof cap 235 and the outer sleeve member 250 extend vertically with the vent pipe 360 that is extending through the roof 320.

Figure 5:
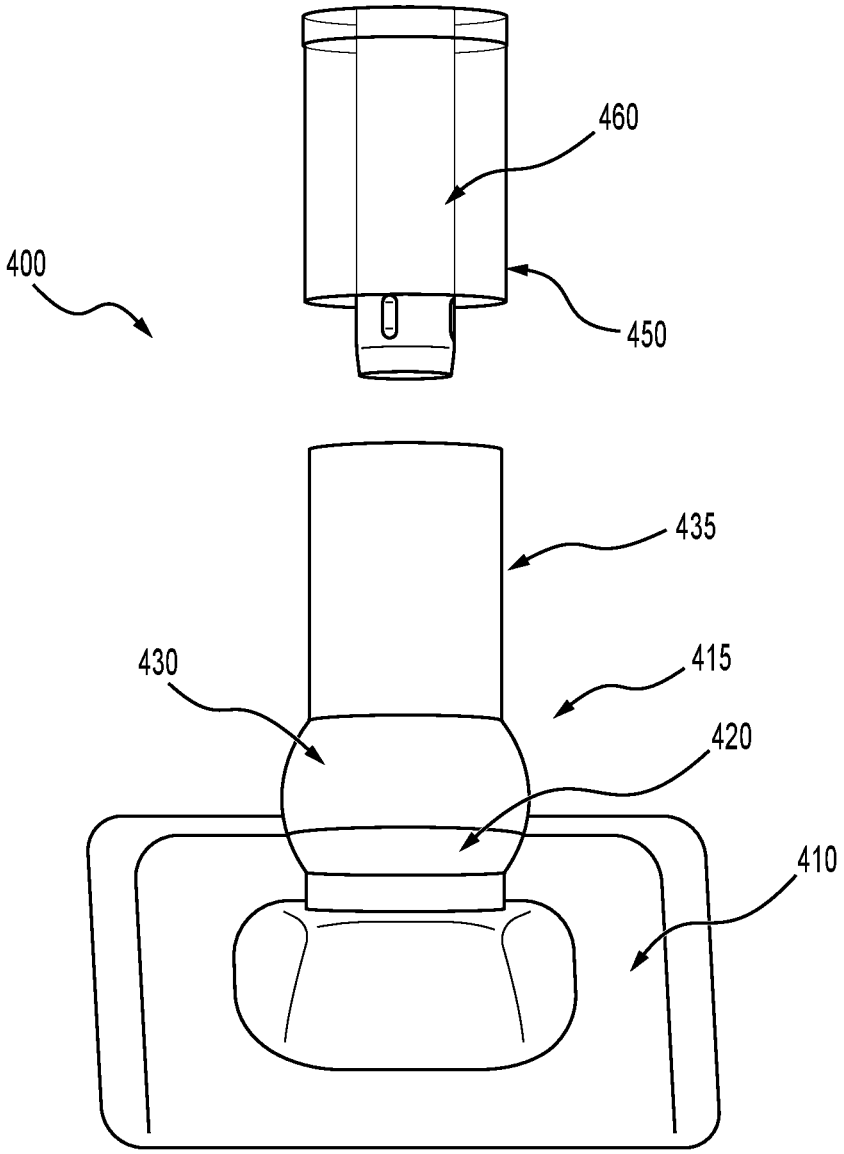
FIG. 5 is an illustration of an adjustable roof vent assembly according to an embodiment of the invention.

FIG. 5 illustrates another embodiment of an adjustable roof vent assembly 400 having an outer sleeve member 450. According to this embodiment, the adjustable roof vent assembly 400 includes a base 410 (e.g., roof flashing) that is configured to attach to a roof (see, e.g., roof 120 of building 150 of FIG. 1A). The base 410 is further configured to allow a vent pipe that extends through the roof to extend through the base 410 (see, e.g., vent pipe 160 that extends through roof 120 of building 150 of FIG. 1B). The adjustable roof vent assembly 400 further includes a ball joint mechanism 415 that includes (i) an inner ball member 420 attached to the base 410 and (ii) an outer ball member 430 having a roof cap 435. In one embodiment, the inner ball member 420 of the ball joint mechanism 415 is mechanically attached to the base 410. The outer ball member 430 is able to freely rotate around the inner ball member 420 (see, e.g., FIGS. 3A and 3B). The roof cap 435 of the outer ball member 430 is configured to extend around a vent pipe that extends through the roof (see, e.g., vent pipe 160 that extends through roof 120 of building 150 of FIG. 1B). As further shown in FIG. 5, the adjustable roof vent assembly 400 also includes an outer sleeve member 450 that can attach and/or engage with the roof cap 435 of the outer ball member 430. For example, according to an embodiment, the outer sleeve member 450 is configured to go around the roof cap 435 of the outer ball member 430. The outer sleeve member 450 further includes an inner sleeve 460 that is configured to go inside of a vent pipe (e.g., a PVC vent pipe) that extends through the roof (see, e.g., vent pipe 160 that extends through roof 120 of building 150 of FIG. 1B). According to an embodiment, the inner sleeve 460 is capable of gripping the inside walls of the vent pipe (e.g., a PVC vent pipe) that extends through the roof (see, e.g., vent pipe 160 that extends through roof 120 of building 150 of FIG. 1B), as described in further detail below.

Figure 6A:
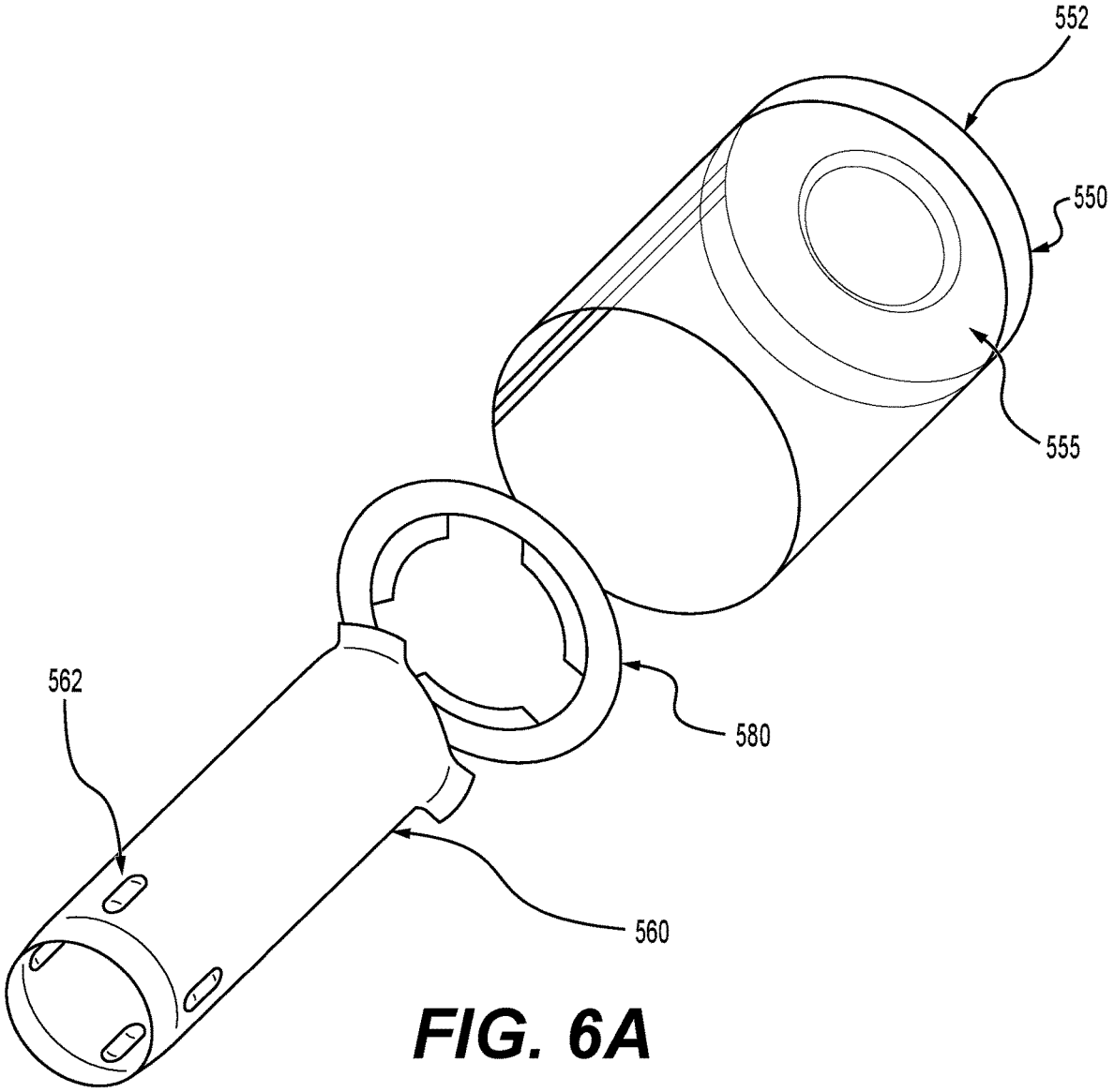
FIG. 6A is an illustration of an outer sleeve member for an adjustable roof vent assembly according to an embodiment of the invention.
Figures 6B, 6C:
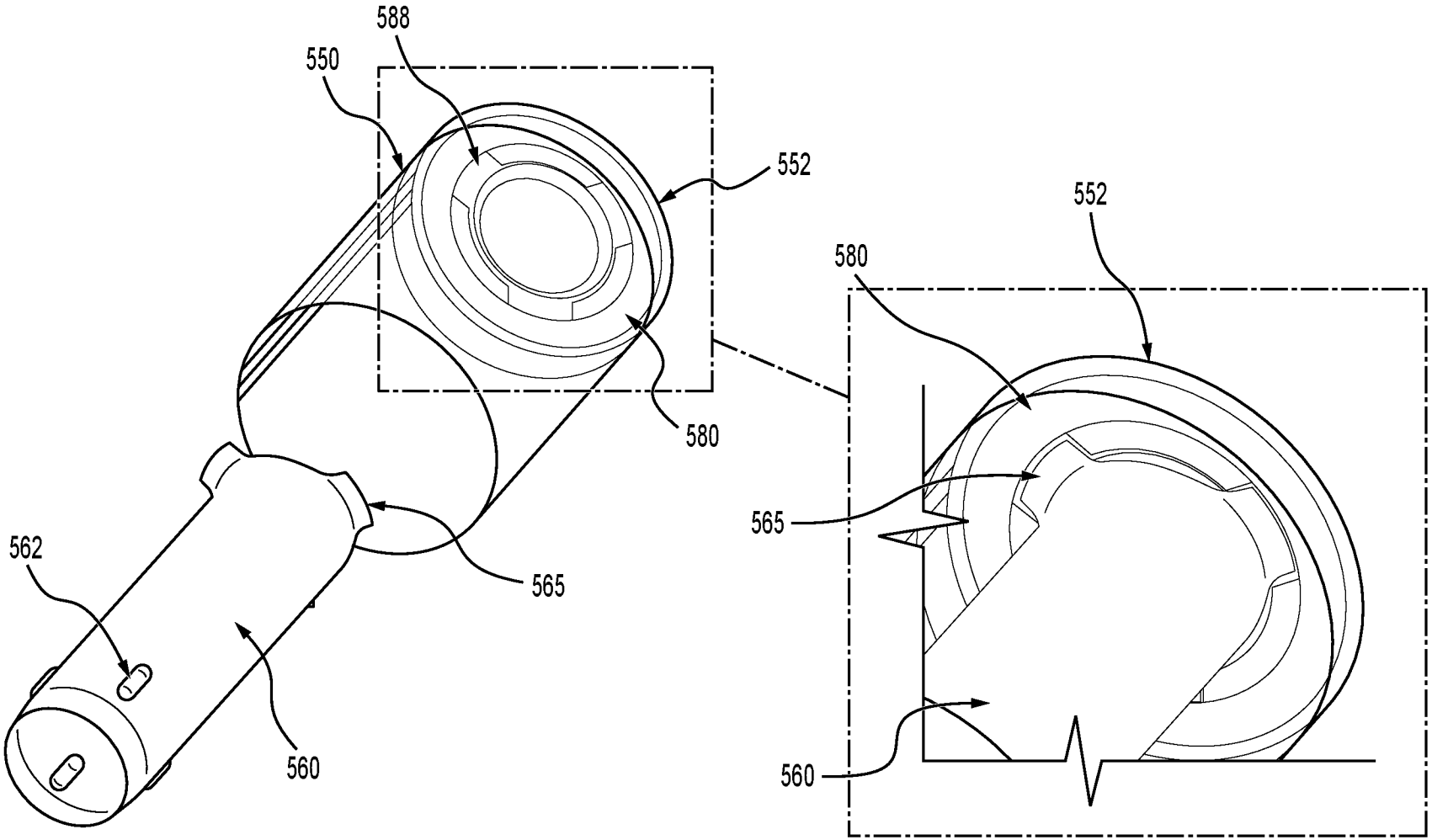
FIG. 6B is another illustration of the outer sleeve member shown in FIG. 6A for an adjustable roof vent assembly according to an embodiment of the invention.
FIG. 6C is a partial, exploded view of a portion of the outer sleeve member shown in FIG. 6B for an adjustable roof vent assembly according to an embodiment of the invention.

FIGS. 6A-6C provide a detailed illustration of an outer sleeve member 550 for an adjustable roof vent assembly according to an embodiment of the invention. As shown in FIGS. 6A-6C, the outer sleeve member 550 includes a top cover 552 ("top cap sub-assembly") and a bezel member 580 (e.g., a "spider bezel") configured to attach to an inner portion 555 of the top cover 552 of the outer sleeve member 550. In one embodiment, the bezel member 580 is mechanically attached (e.g., welded or spot welded) to the inner portion 555 of the top cover 552 of the outer sleeve member 550. The outer sleeve member 550 further includes an inner sleeve 560 that is configured to attach to and/or engage with the bezel member 580. In particular, as shown in FIGS. 6B and 6C, according to one embodiment, the inner sleeve 560 comprises one or more tab members 565 that are configured to engage with the bezel member 580. For example, as shown in FIGS. 6B and 6C, the bezel member 580 includes one or more slots 588 that are configured to engage with the one or more tab members 565 of the inner sleeve 560 to attach the inner sleeve 560 to the bezel member 580. In this regard, the tabs 565 of the inner sleeve 560 are configured to line up with the corresponding slots 588 of the bezel member 580.

In one embodiment, the inner sleeve includes one or more protrusions that are configured to grip an inside wall of the vent pipe that extends from the roof. For example, FIGS. 6A and 6B further illustrate the inner sleeve 560 including one or more protrusions 562 that are configured to grip an inside wall of a vent pipe that extends from a roof (see, e.g., vent pipe 160 that extends through roof 120 of building 150 of FIG. 1B).

Figure 7:
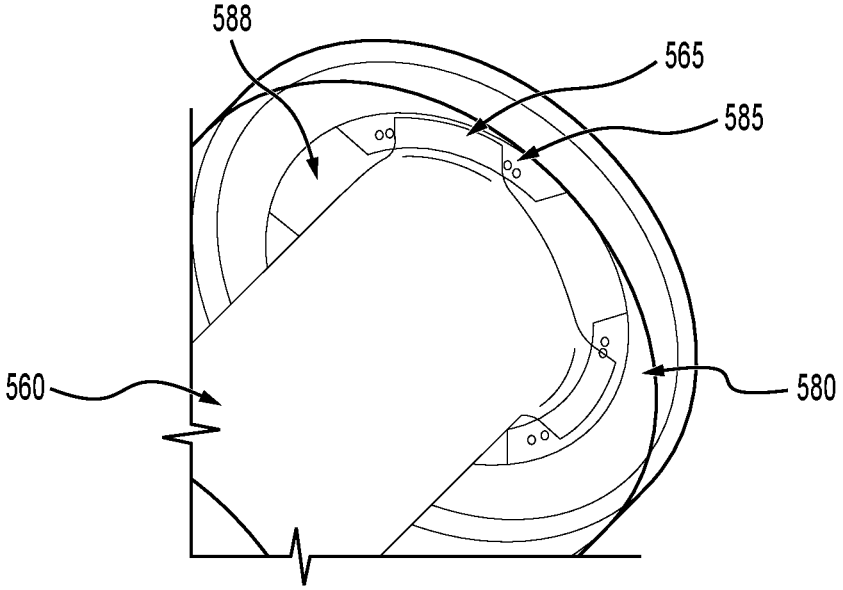
FIG. 7 is a partial, exploded view of the portion of the outer sleeve member shown in FIG. 6C for an adjustable roof vent assembly according to an embodiment of the invention.

In another embodiment, the bezel member further includes one or more detents that are configured to (i) hold the inner sleeve in place and (ii) prevent over-rotation of the inner sleeve when attaching the inner sleeve to the bezel member. For example, FIG. 7 provides an illustration of the bezel member 580 having one or more detents 585 according to one embodiment of the invention. As shown in FIG. 7, the bezel member 580 includes the one or more slots 588 that are configured to engage with the one or more tab members 565 of the inner sleeve 560 to attach the inner sleeve 560 to the bezel member 580. The bezel member 580 further includes one or more detents 585 to hold the inner sleeve 560 tightly in place, as well as provide a hard stop to prevent over-rotation of the inner sleeve 560. According to one embodiment, the inner sleeve 560 is twisted in order to lock the inner sleeve 560 into the bezel member 580 (e.g., via the one or more slots 588 that are configured to engage with the one or more tab members 565 of the inner sleeve 560).

Figure 8:
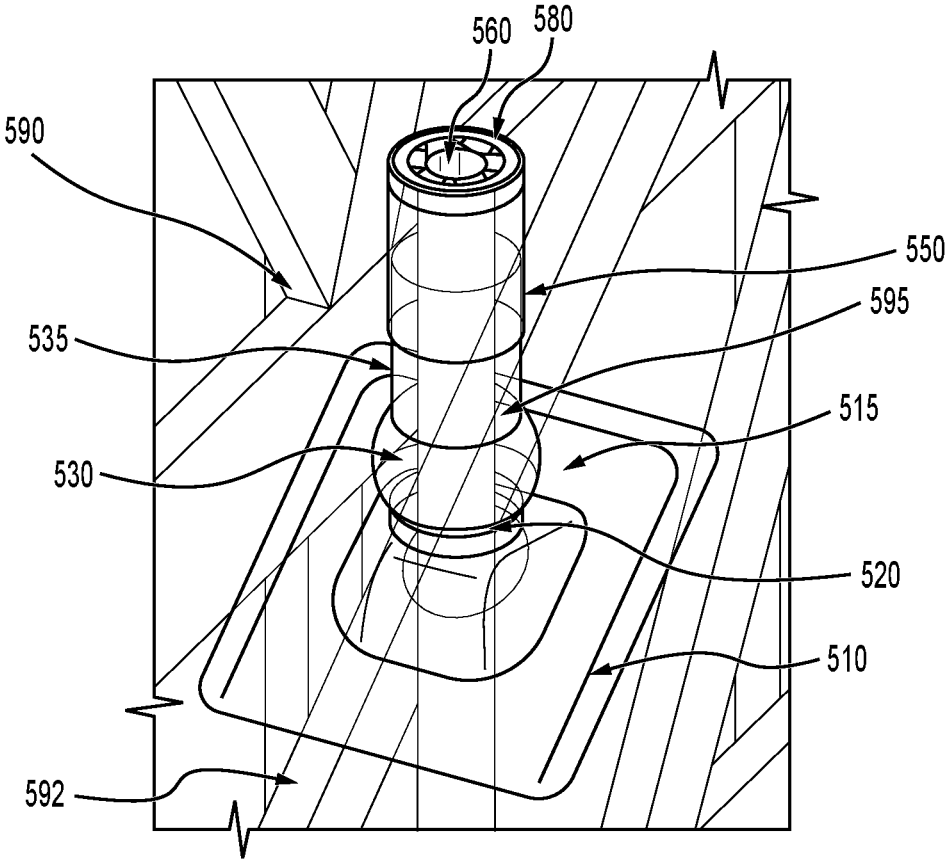
FIG. 8 is an illustration of an adjustable roof vent assembly positioned on a roof according to an embodiment of the invention.

FIG. 8 illustrates the outer sleeve member 550 of FIGS. 6A-6C being provided on an adjustable roof vent assembly 590 that is positioned on a vent pipe 595 extending through a roof 592 according to an embodiment of the invention. As shown in FIG. 8, the adjustable roof vent assembly 590 includes a base 510 (e.g., roof flashing) that is configured to attach to the roof 592. The base 510 is further configured to allow the vent pipe 595 that extends through the roof 592 to extend through the base 510. The adjustable roof vent assembly 590 further includes a ball joint mechanism 515 that includes (i) an inner ball member 520 attached to the base 510 and (ii) an outer ball member 530 having a roof cap 535. The outer ball member 530 is able to freely rotate around the inner ball member 520 (see, e.g., FIGS. 3A and 3B). The roof cap 535 of the outer ball member 530 is configured to extend around the vent pipe 595 that extends through the roof 592. As further shown in FIG. 8, the adjustable roof vent assembly 590 also includes the outer sleeve member 550 (as shown in, e.g., FIGS. 6A-6C) that can attach to and/or engage with the roof cap 535 of the outer ball member 530. For example, according to an embodiment, the outer sleeve member 550 is configured to go around the roof cap 535 of the outer ball member 530. The outer sleeve member 550 further includes the inner sleeve 560 that is configured to go inside of the vent pipe 595 (e.g., a PVC vent pipe) that extends through the roof 592. According to an embodiment, the inner sleeve 560 is capable of gripping the inside walls of the vent pipe 595 (e.g., a PVC vent pipe) that extends through the roof 592. Also shown in FIG. 8, is the bezel member 580 of the outer sleeve member 550 that is configured to attach to and/or engage with the inner sleeve 560 as described above.

Figure 13A:
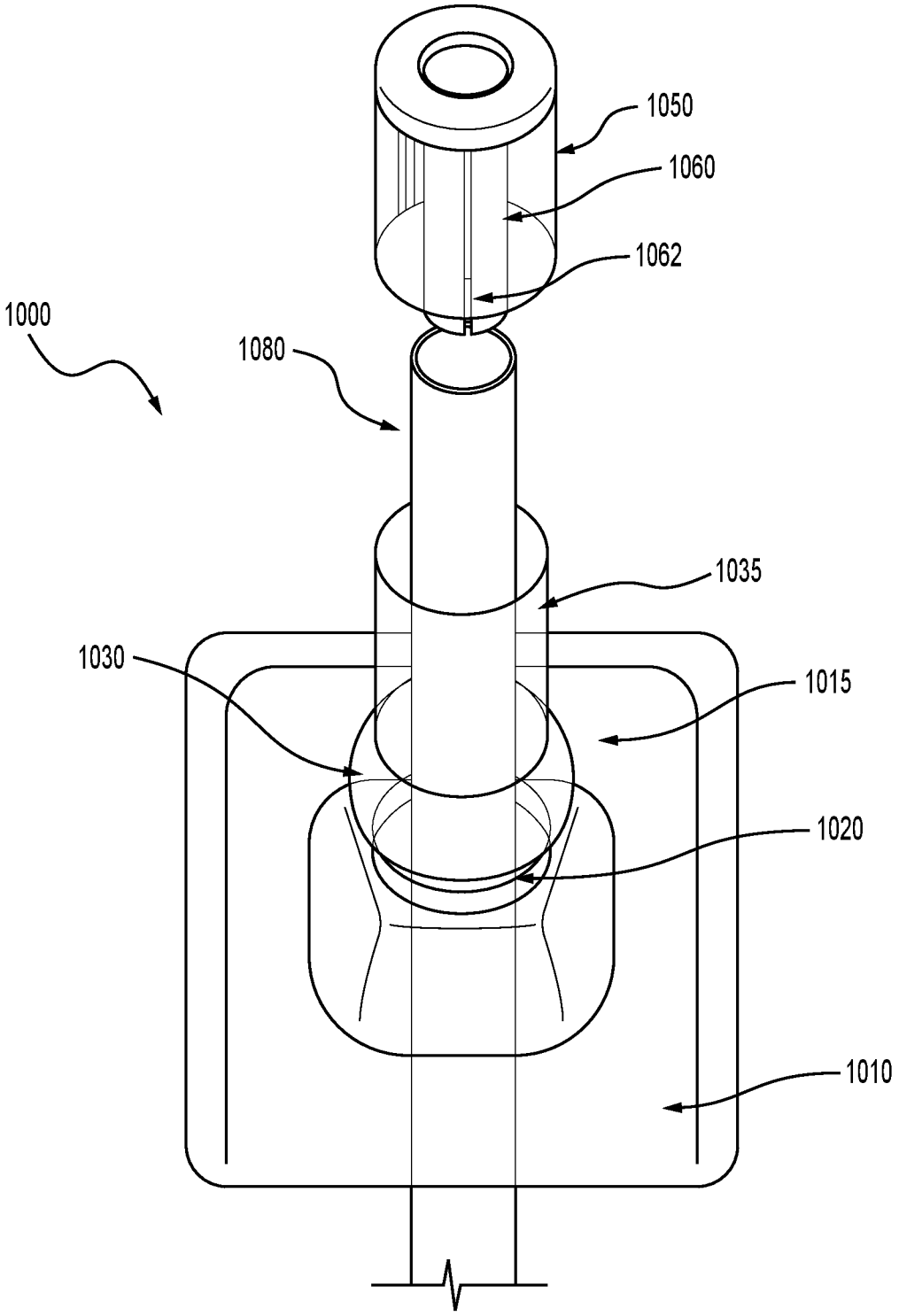
FIG. 13A is an illustration of an adjustable roof vent assembly positioned on a vent pipe according to an embodiment of the invention.
Figure 13B:
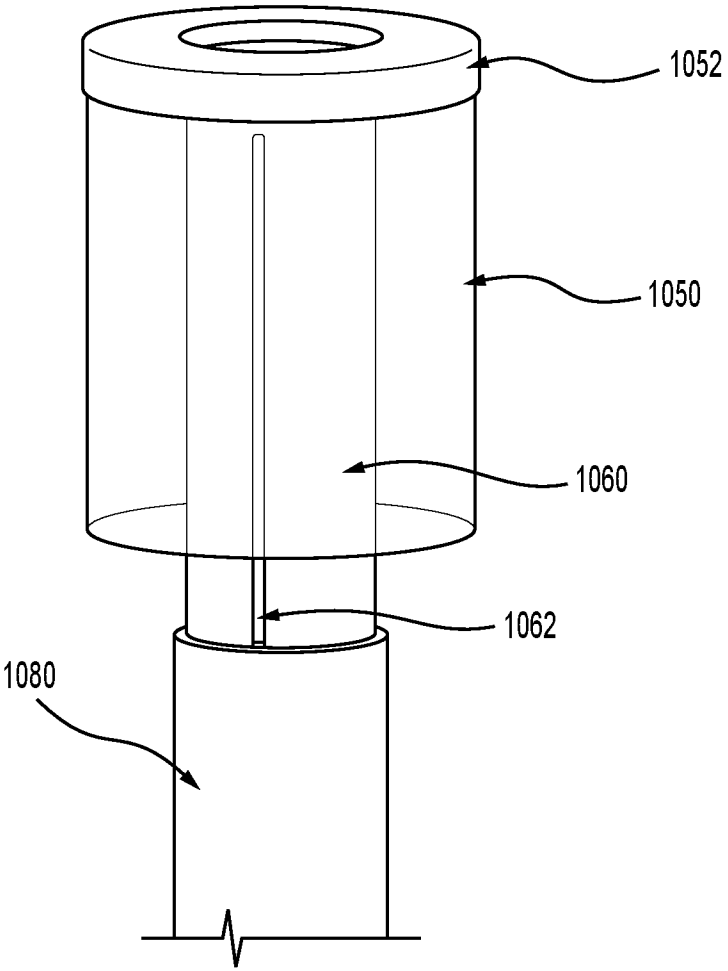
FIG. 13B is a partial, exploded view of an outer sleeve member of the adjustable roof vent assembly shown in FIG. 13A according to an embodiment of the invention.

FIGS. 13A and 13B illustrate another embodiment of an adjustable roof vent assembly 1000 having an outer sleeve member 1050. According to this embodiment, the adjustable roof vent assembly 1000 includes a base 1010 (e.g., roof flashing) that is configured to attach to a roof (see, e.g., roof 120 of building 150 of FIG. 1A). The base 1010 is further configured to allow a vent pipe 1080 (e.g., a schedule 40 series sewer vent pipe) that extends through the roof to extend through the base 1010. The adjustable roof vent assembly 1000 further includes a ball joint mechanism 1015 that includes (i) an inner ball member 1020 attached to the base 1010 and (ii) an outer ball member 1030 having a roof cap 1035. In one embodiment, the inner ball member 1020 of the ball joint mechanism 1015 is mechanically attached to the base 1010. The outer ball member 1030 is able to freely rotate around the inner ball member 1020 (see, e.g., FIGS. 3A and 3B). The roof cap 1035 of the outer ball member 1030 is configured to extend around the vent pipe 1080 that extends through the roof.

As further shown in FIG. 13A, the adjustable roof vent assembly 1000 also includes an outer sleeve member 1050 that can attach to and/or engage with the roof cap 1035 of the outer ball member 1030. For example, according to an embodiment, the outer sleeve member 1050 is configured to go around the roof cap 1035 of the outer ball member 1030. The outer sleeve member 1050 further includes an inner sleeve 1060 that is configured to go inside of the vent pipe 1080 that extends through the roof. According to the embodiment of FIGS. 13A and 13B, the inner sleeve 1060 includes one or more slits 1062 that are configured to adapt to a diameter of the vent pipe 1080 (i.e., the internal diameter of the vent pipe 1080) that extends through the roof. According to one embodiment, the inner sleeve 1060 is comprised of a plastic material (e.g., a polymeric material) to provide a plastic pipe adapter sleeve with the one or more slits 1062 that are configured to adapt to the varying internal diameters of the vent pipe 1080 that extends through the roof.

FIG. 13B further provides a partial, exploded view of the outer sleeve member 1050 of the adjustable roof vent assembly 1000 shown in FIG. 13A. As shown in FIG. 13B, the outer sleeve member 1050 includes a top cover 1052 ("top cap sub-assembly") that is configured to attach to and/or engage with the inner sleeve 1060 (see, e.g., FIGS. 6A-6C). FIG. 13B further illustrates the one or more slits 1062 of the inner sleeve 1060 that are configured to adapt to a diameter of the vent pipe 1080 (i.e., the internal diameter of the vent pipe 1080) that extends through the roof. In particular, FIG. 13B illustrates the inner sleeve 1060 having the one or more slits 1062 being positioned inside of the vent pipe 1080 that extends through the roof. While the embodiment of FIGS. 13A and 13B illustrates the one or more slits 1062 extending the majority of the length of the inner sleeve 1060, the one or more slits 1062 can be non-existent or can extend any length along the inner sleeve 1060. According to one embodiment, the length or distance that the one or more slits 1062 extends along the inner sleeve 1060 allows for flexibility to use different materials (such as, e.g., polymers) that can be molded with the one or more slits 1062 to accommodate various applications in the field.

Figure 14:
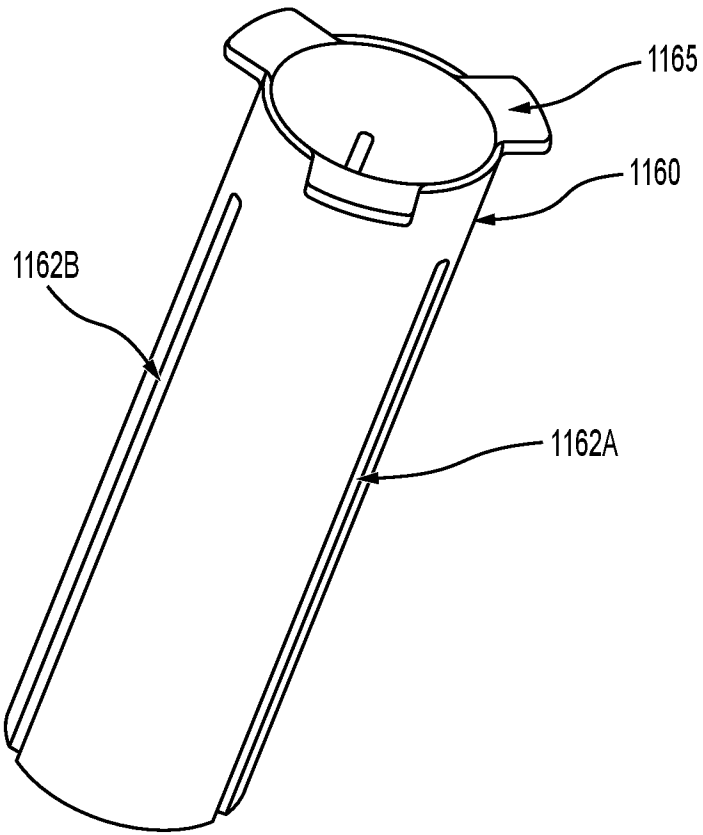
FIG. 14 is an illustration of an inner sleeve of an adjustable roof vent assembly according to an embodiment of the invention.

FIG. 14 illustrates another embodiment of an inner sleeve 1160 that is configured to attach to and/or engage with an outer sleeve member (not shown) of an adjustable roof vent assembly. As shown in FIG. 14, the inner sleeve 1160 includes at least two slits 1162A, 1162B that are configured to adapt to a diameter (i.e., an inner diameter) of a vent pipe (see, e.g., vent pipe 1080 of FIGS. 13A and 13B) that extends through the roof. The inner sleeve 1160 further includes one or more tab members 1165 that are configured to engage with, e.g., a bezel member that attaches to a top cover of an outer sleeve member (see, e.g., FIGS. 6A-6C). While the embodiment of FIG. 14 illustrates the at least two slits 1162A, 1162B extending the majority of the length of the inner sleeve 1160, the at least two slits 1162A, 1162B can be non-existent or can extend any length along the inner sleeve 1160. According to one embodiment, the length or distance that the at least two slits 1162A, 1162B extends along the inner sleeve 1160 allows for flexibility to use different materials (such as, e.g., polymers) that can be molded with the one or more slits 1162 to accommodate various applications in the field.

Another embodiment of this invention pertains to an adjustable roof vent assembly that allows for roof top connectivity. The adjustable roof vent assembly comprises (a) a base configured to attach to a roof, wherein the base is configured to allow a vent pipe that extends from the roof to extend through the base, (b) a ball joint mechanism that includes (i) an inner ball member attached to the base and (ii) an outer ball member having a roof cap, wherein the outer ball member is configured to freely rotate around the inner ball member, and wherein the roof cap is configured to extend around the vent pipe, and (c) an antenna disposed within the adjustable roof vent assembly to allow for the adjustable roof vent assembly to be used as an antenna for roof top connectivity.

Figure 9:
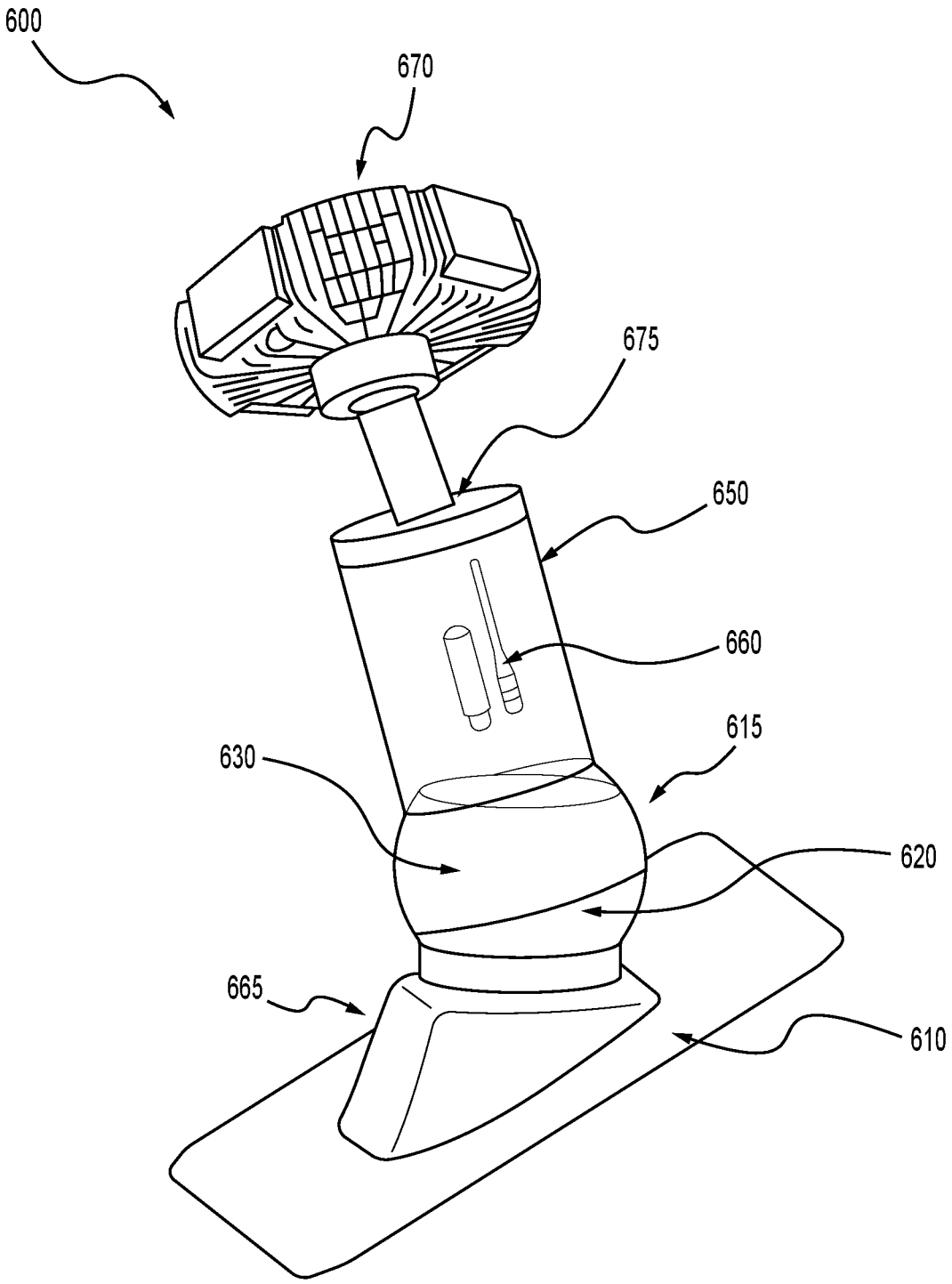
FIG. 9 is an illustration of an adjustable roof vent assembly according to an embodiment of the invention.

FIG. 9 illustrates an adjustable roof vent assembly 600 having roof top connectivity according to an embodiment of the invention. In this embodiment, the adjustable roof vent assembly 600 includes a base 610 (e.g., roof flashing) that is configured to attach to a roof (see, e.g., roof 120 of building 150 of FIG. 1A). The base 610 is further configured to allow a vent pipe that extends through the roof to extend through the base 610 (see, e.g., vent pipe 160 that extends through roof 120 of building 150 of FIG. 1B). The adjustable roof vent assembly 600 further includes a ball joint mechanism 615 that includes (i) an inner ball member 620 attached to the base 610 and (ii) an outer ball member 630 having a roof cap (not shown). The roof cap (not shown) of the outer ball member 630 is configured to extend around a vent pipe that extends through the roof (see, e.g., vent pipe 160 that extends through roof 120 of building 150 of FIG. 1B). In one embodiment, the inner ball member 620 of the ball joint mechanism 615 is mechanically attached to the base 610. The outer ball member 630 is able to freely rotate around the inner ball member 620 (see, e.g., FIGS. 3A and 3B). As further shown in FIG. 9, the adjustable roof vent assembly 600 also includes an outer sleeve member 650 that can attach to and/or engage with the roof cap (not shown) of the outer ball member 630. According to this embodiment, and as shown in FIG. 9, at least one antenna 660 is disposed within (or hidden inside) of the outer sleeve member 650. According to one embodiment, the at least one antenna 660 comprises a non-metal for signal transmission. As further shown in FIG. 9, antenna electronics 665 are disposed within (or hidden inside) of the base 610 (e.g., roof flashing). In addition, the outer sleeve member 650 comprises a top cover 675 that provides a mounting point for one or more antennas 670.

According to an embodiment, the various elements of the adjustable roof vent assemblies discussed above, including, e.g., the base (see, e.g., base 210 of FIG. 2), the ball joint mechanism (see, e.g., ball joint mechanism 215 of FIG. 2) that includes (i) an inner ball member attached to the base (see, e.g., inner ball member 220 of FIG. 2) and (ii) an outer ball member having a roof cap (see, e.g., outer ball member 230 having roof cap 235 of FIG. 2), the outer sleeve member (see, e.g., outer sleeve member 250 of FIG. 2), and the inner sleeve (see, e.g., inner sleeve 460 of FIG. 5), are comprised of any types of materials of construction. For example, the various elements of the adjustable roof vent assembly can be comprised of metal, plastic or polymeric materials, or any other types of materials of construction. According to one embodiment, each of the elements of the adjustable roof vent assembly are comprised of the same materials, different materials, or a combination thereof.

Another embodiment of this invention pertains to a method of manufacturing a roof vent assembly. The method comprises (a) obtaining an outer ball member, (b) obtaining a cylindrical inner tube member, (c) inserting the cylindrical inner tube member into the outer ball member, such that the outer ball member is positioned around the cylindrical inner tube member, and expanding the cylindrical inner tube member within the outer ball member to form an inner ball member of a ball joint mechanism of a roof vent assembly.

Figure 10:
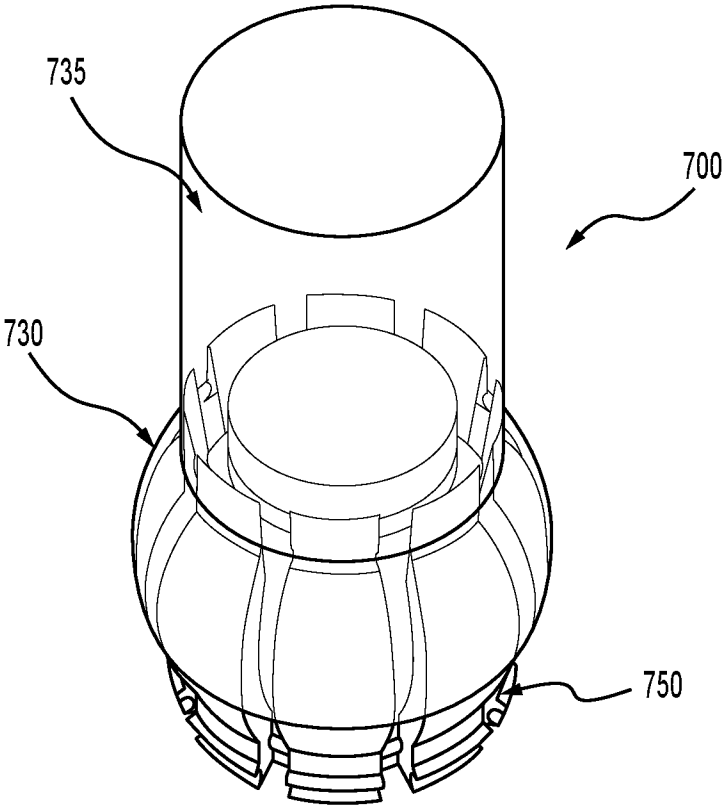
FIG. 10 is an illustration of an expander tool for preparing an outer ball member for an adjustable roof vent assembly according to an embodiment of the invention.

FIGS. 10-12B illustrate a method of manufacturing the elements of a roof vent assembly according to an embodiment of the invention. In particular, FIG. 10 illustrates a first step of the method in which a cylindrical tube 700 (or round tube) is used to form an outer ball member 730 (e.g., an outer sphere) of a ball joint mechanism (or ball joint) of a roof vent assembly, with the outer ball member 730 having a roof cap 735 and having been formed using an expander tool 750. As shown in FIG. 10, the expander tool 750 is in an expanded state in order to expand the cylindrical tube 700 into the shape and form of the outer ball member 730 (or outer sphere) of the ball joint mechanism (or ball joint).

Figure 11:
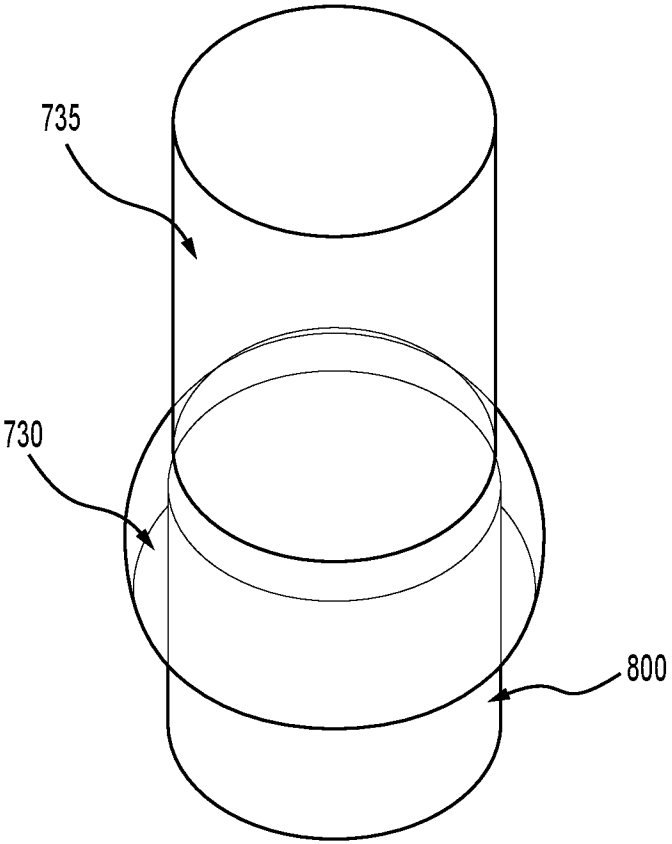
FIG. 11 is an illustration of a cylindrical inner tube member for preparing an inner ball member for an adjustable roof vent assembly according to an embodiment of the invention.

FIG. 11 illustrates a second step of the method in which a cylindrical inner tube member 800 (or round inner tube) is inserted or placed into (or inside of) the outer ball member 730 having the roof cap 735 that was formed in the first step (e.g., see FIG. 10), such that the outer ball member 730 is positioned around the cylindrical inner tube member 800.

Figure 12B:
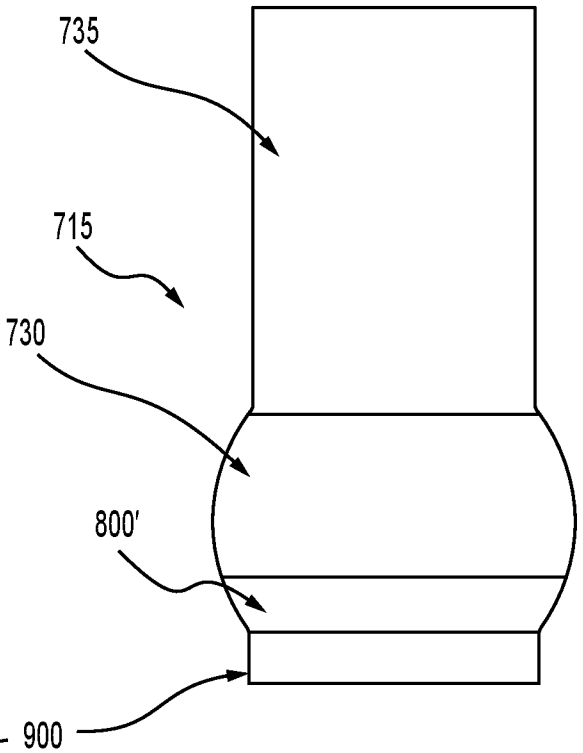
FIGS. 12A and 12B are illustrations of a cylindrical inner tube member being expanded for preparing an inner ball member for an adjustable roof vent assembly according to an embodiment of the invention.
Figure 12A:
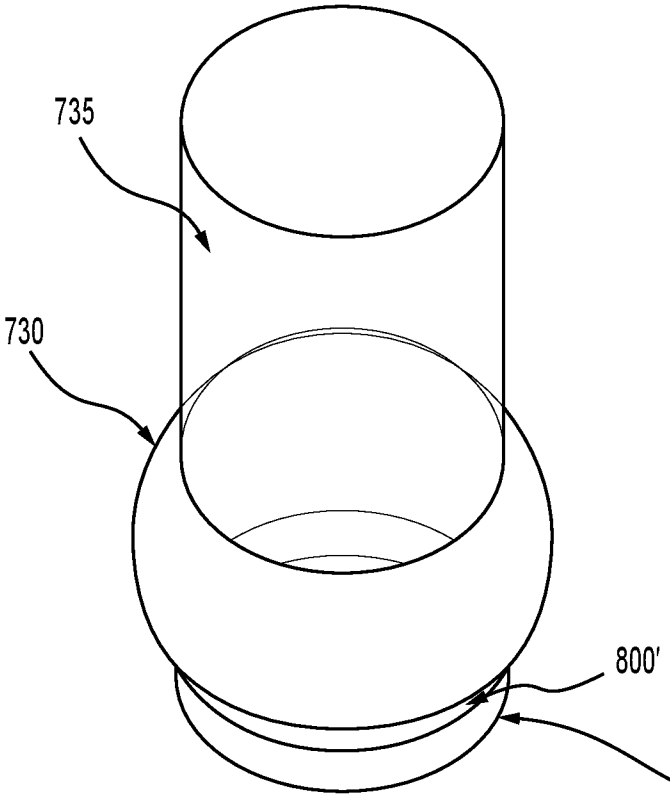

FIGS. 12A and 12B illustrate a third step of the method in which an inner ball member 800' (e.g., a sphere) of a ball joint mechanism 715 is formed inside of the outer ball member 730 using expander tooling. In this regard, the cylindrical inner tube member 800 of FIG. 11 is expanded within the outer ball member 730 having the roof cap 735 to form an inner ball member 800' of a ball joint mechanism 715 (or ball joint) of a roof vent assembly. In particular, as shown in FIGS. 12A and 12B, the cylindrical inner tube member 800 of FIG. 11 is expanded using an expander tool 900. According to one embodiment, the expander tool 900 is configured to adjust from an unexpanded state to an expanded state to expand the cylindrical inner tube member 800 within the outer ball member 730 to form the inner ball member 800' of the ball joint mechanism 715 of a roof vent assembly. Thus, once the expander tool 900 is in an expanded state (not shown), the cylindrical inner tube member 800 of FIG. 11 is expanded into the shape and form of the inner ball member 800' of the ball joint mechanism 715 (or ball joint), using the spherical shape of the outer ball member 730 that is positioned around the cylindrical inner tube member 800.

In one embodiment, the step of expanding the cylindrical inner tube member is conducted using a material expansion process. In another embodiment, the material expansion process comprises a metal expansion process.

In one embodiment, the step of expanding the cylindrical inner tube member is conducted until the cylindrical inner tube member is expanded to form an inner ball member that is sized smaller than the outer ball member.

In one embodiment, the ball joint mechanism comprises a ball and socket joint.

According to embodiments described herein, a method of producing a ball joint mechanism (e.g., a ball and socket joint) in sheet metal is provided using an expansion process, including, e.g., a two-step expansion process (as opposed to a multi-step manual process conventionally used). For example, according to an embodiment, a sheet metal ball joint is fabricated by expanding tubular shapes.

According to one embodiment, the present invention provides a method to manufacture sheet metal ball joints with consistent quality and reduced labor.

According to one embodiment, an adjustable roof vent assembly according to the embodiments described above is formed by injection molding.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. An adjustable roof vent assembly comprising:

(a) a base configured to attach to a roof, wherein the base comprises a roof flashing;

(b) a ball joint mechanism that includes (i) an inner ball member attached to the base and (ii) an outer ball member that extends into a roof cap having an opening for receiving at least one antenna, wherein the outer ball member is configured to freely rotate around the inner ball member;

(c) a top cover that engages with the roof cap of the outer ball member, the top cover having an opening for receiving at least one antenna and being positioned on the roof cap of the outer ball member; and (d) at least one antenna positioned within the opening of the roof cap of the outer ball member and the opening of the top cover of the adjustable roof vent assembly to allow for the adjustable roof vent assembly to be used as an antenna for roof top connectivity, wherein the at least one antenna is mounted to the top cover.

2. The adjustable roof vent assembly according to claim 1, wherein the base includes antenna electronics.

3. The adjustable roof vent assembly according to claim 1, further comprising an outer sleeve member that is configured to be positioned on the roof cap of the outer ball member.

4. The adjustable roof vent assembly according to claim 3, wherein the outer sleeve member includes at least one additional antenna.

5. The adjustable roof vent assembly according to claim 4, wherein the at least one additional antenna comprises a non-metal for signal transmission.

6. The adjustable roof vent assembly according to claim 3, wherein the outer sleeve member comprises the top cover that provides a mounting point for the at least one antenna.

7. The adjustable roof vent assembly according to claim 3, wherein the outer sleeve member includes an inner sleeve that is configured to be positioned within a conduit that extends from the roof.

8. The adjustable roof vent assembly according to claim 7, wherein the outer sleeve member further includes the top cover and a bezel member, wherein the bezel member is attached to an inner portion of the top cover.

9. The adjustable roof vent assembly according to claim 8, wherein the inner sleeve comprises one or more tab members that are configured to engage with the bezel member.

10. The adjustable roof vent assembly according to claim 9, wherein the bezel member includes one or more slots that are configured to engage with the one or more tab members of the inner sleeve to attach the inner sleeve to the bezel member.

11. The adjustable roof vent assembly according to claim 10, wherein the bezel member further includes one or more detents that are configured to (i) hold the inner sleeve in place and (ii) prevent over-rotation of the inner sleeve when attaching the inner sleeve to the bezel member.

12. The adjustable roof vent assembly according to claim 8, wherein the bezel member is welded to the inner portion of the top cover of the outer sleeve member.

13. The adjustable roof vent assembly according to claim 7, wherein the inner sleeve includes one or more protrusions that are configured to grip an inside wall of a conduit that extends from the roof.

14. The adjustable roof vent assembly according to claim 7, wherein the inner sleeve includes one or more slits that are configured to adapt to a diameter of a conduit that extends from the roof.

15. The adjustable roof vent assembly according to claim 7, wherein the inner sleeve comprises a plastic material.

16. The adjustable roof vent assembly according to claim 1, wherein the inner ball member of the ball joint mechanism is mechanically attached to the base.

17. The adjustable roof vent assembly according to claim 1, wherein the ball joint mechanism is configured to allow for free rotation of the adjustable roof vent assembly in two planes while reducing lateral movement in any direction.

18. The adjustable roof vent assembly according to claim 1, wherein the ball joint mechanism is configured to allow for free rotation of the adjustable roof vent assembly in two planes while preventing lateral movement in any direction.

* * * * *